US006612468B2

(12) United States Patent
Pritchett et al.

(10) Patent No.: US 6,612,468 B2
(45) Date of Patent: Sep. 2, 2003

(54) DISPENSER PUMPS

(75) Inventors: David John Pritchett, West Hallam (GB); Brian Robert Law, Leicester (GB); Jeffrey William Spencer, Leicestershire (GB)

(73) Assignee: Rieke Corporation, Auburn, IN (US)

( * ) Notice: Subject to any disclaimer, the term of this patent is extended or adjusted under 35 U.S.C. 154(b) by 0 days.

(21) Appl. No.: 09/954,664

(22) Filed: Sep. 12, 2001

(65) Prior Publication Data

US 2002/0070238 A1 Jun. 13, 2002

(30) Foreign Application Priority Data

Sep. 15, 2000 (GB) ..... 0022700
Feb. 28, 2001 (GB) ..... 0105003

(51) Int. Cl.[7] ..... B67D 5/58
(52) U.S. Cl. ..... 222/190; 222/321.4; 222/481.5
(58) Field of Search ..... 222/145.6, 190, 222/321.2, 321.4, 321.7, 321.9, 380, 383.1, 481.5

(56) References Cited

U.S. PATENT DOCUMENTS

| | | | | |
|---|---|---|---|---|
| 3,973,701 A | | 8/1976 | Gardner | 222/190 |
| 4,432,496 A | | 2/1984 | Ito | |
| 4,509,661 A | | 4/1985 | Sugizaki et al. | |
| 4,615,467 A | | 10/1986 | Grogan et al. | |
| 4,932,567 A | | 6/1990 | Tanabe et al. | 222/190 |
| 5,048,750 A | | 9/1991 | Tobler | |
| 5,064,103 A | * | 11/1991 | Bennett | 222/190 |
| 5,147,087 A | | 9/1992 | Fuchs | 239/337 |
| 5,156,307 A | * | 10/1992 | Callahan et al. | 222/190 |
| 5,271,530 A | | 12/1993 | Uehira et al. | 222/190 |
| 5,289,952 A | | 3/1994 | Gueret | 222/190 |
| 5,445,288 A | | 8/1995 | Banks | |
| 5,462,208 A | | 10/1995 | Stahley et al. | 222/207 |
| 5,570,819 A | * | 11/1996 | Uehira et al. | 222/190 |
| 5,779,104 A | | 7/1998 | Reidel | |
| 5,813,576 A | | 9/1998 | Iizuka et al. | 222/190 |
| 6,053,364 A | | 4/2000 | van der Heijden | |
| 6,082,586 A | | 7/2000 | Banks | 222/105 |
| 6,398,079 B1 | * | 6/2002 | Garcia et al. | 222/190 |

FOREIGN PATENT DOCUMENTS

| | | |
|---|---|---|
| CA | 1 150 687 | 7/1983 |
| DE | 1 201 684 | 9/1965 |

(List continued on next page.)

OTHER PUBLICATIONS

Patent Abstracts of Japan, vol. 1999, No. 3, Mar. 31, 1999 & JP 10 324357 (Daiwa Can Co Ltd), Dec. 8, 1998.

*Primary Examiner*—Joseph A. Kaufman
(74) *Attorney, Agent, or Firm*—Fay, Sharpe, Fagan, Minnich & McKee, LLP

(57) ABSTRACT

A hand operated non-aerosol foam dispenser comprising a combined liquid pump and air pump for mounting at the top of a container of foamable liquid, the liquid pump having a liquid cylinder and a liquid piston defining between them a liquid chamber, the air pump having an air cylinder and an air piston defining between them an air chamber, and the liquid piston and air piston being reciprocable together in their respective cylinders by the action of a pump plunger which carries said pistons;

an air inlet valve and liquid inlet valve being provided for the air chamber and liquid chamber respectively;

an air discharge passage and a liquid discharge passage leading from the air chamber and the liquid chamber respectively, the air discharge passage and liquid discharge passage meeting one another for mixing the pumped air and liquid which passes to an outlet passage of the dispenser by way of a permeable foam regulation element;

one or more vent openings being provided to admit air into a cap chamber and into the air chamber through the air inlet valve.

28 Claims, 13 Drawing Sheets

FOREIGN PATENT DOCUMENTS

| | | | |
|---|---|---|---|
| DE | 2 001 921 | | 7/1970 |
| DE | 28 25 223 | | 12/1978 |
| DE | 25 05 493 | C3 | 2/1980 |
| DE | 19 43 583 | C3 | 1/1981 |
| DE | 31 34 265 | | 3/1983 |
| DE | 35 09 178 | | 9/1986 |
| DE | 31 04 321 | | 10/1988 |
| DE | 31 05 371 | | 10/1989 |
| DE | 38 17 632 | | 11/1989 |
| DE | 690 17 922 | | 3/1995 |
| EP | 0 196 737 | | 10/1986 |
| EP | 0 460 154 | | 4/1993 |
| EP | 0 392 238 | | 1/1995 |
| EP | 0 565 713 | | 3/1995 |
| EP | 0 736 462 | | 10/1996 |
| EP | 0 618 147 | | 5/1997 |
| EP | 0 613 728 | | 8/1997 |
| GB | 1389615 | | 4/1975 |
| JP | 57-111362 | | 12/1980 |
| JP | 57-20285 | | 4/1982 |
| JP | 58-2459 | | 1/1983 |
| JP | 58-23415 | | 5/1983 |
| JP | 60-24426 | | 7/1985 |
| JP | 62-60555 | | 4/1987 |
| JP | 62-101747 | | 6/1987 |
| JP | 62-177653 | | 11/1987 |
| JP | 63-21250 | | 2/1988 |
| JP | 63-23251 | | 2/1988 |
| JP | 1-156759 | | 10/1989 |
| JP | 2-34774 | | 3/1990 |
| JP | 4-293568 | | 10/1992 |
| JP | 9-1009 | | 1/1997 |
| JP | 9-99260 | | 4/1997 |
| JP | 10034035 | | 2/1998 |
| JP | 2000-51748 | | 2/2000 |
| JP | 2000128215 | | 5/2000 |
| JP | 2000142751 | | 5/2000 |
| JP | 2000219254 | | 8/2000 |
| JP | 2000238871 | | 9/2000 |
| WO | 97/13585 | | 4/1997 |
| WO | 99/49769 | | 10/1999 |
| WO | 99/54054 | | 10/1999 |
| WO | 00/64593 | | 11/2000 |
| WO | 01/39893 | | 6/2001 |
| WO | 01/40077 | | 6/2001 |

* cited by examiner

DISPENSER PUMPS

FIELD OF THE INVENTION

The present proposals have to do with hand-operated dispenser pumps, and partially in certain aspects to such pumps adapted for the dispensing of foam from a supply of foamable liquid in a container to which the dispenser is fitted.

BACKGROUND

Over the last 15 years or so the use of foam dispensers based on aerosols using pressurized gas has declined steeply for environmental reasons, leading the development of foaming dispensers which exploit a manual pumping action to blend air and liquid and create foam.

A particular category of such known dispensers to which certain of the present proposals relate (referred to in what follows as foaming dispensers "of the kind described") provides both a liquid pump and an air pump mounted at the top of a container for the foamable liquid. The liquid pump has a liquid pump chamber defined between a liquid cylinder and a liquid piston, and the air pump has an air pump chamber defined between an air cylinder and an air piston. Preferably these components are arranged concentrically around a plunger axis of the pump. The liquid piston and air piston are reciprocable together in their respective cylinders by the action of a pump plunger: typically the two pistons are integrated with the plunger. An air inlet valve and a liquid inlet valve are provided for the air chamber and liquid chamber. An air discharge passage and a liquid discharge passage lead from the respective chambers to an outlet passage by way of a permeable foam-generating element, preferably one or more mesh layers, through which the air and liquid pass as a mixture. Preferably the air discharge passage and liquid discharge passage meet in a mixing chamber or mixing region immediately upstream of the permeable foam-generating element.

It is not easy to achieve a good quality foam consistently from dispensers of the kind described. There are also difficulties in providing for adequate venting and valving of the different fluid spaces and paths while assuring a positive operation without leaks.

EP-A-565713 (equivalent to U.S. Pat. No. 5,271,530) describes admitting air to the air cylinder through a ball valve in the top wall of the air piston. This does not work when wet, nor when the plunger is pressed slowly, and there is a problem of liquid entering the air chamber via the mixing chamber and air discharge passage.

EP-A-613728 refines the air valving using a single elastomeric annulus in the air piston roof whose outer rim acts as an air inlet flap valve and whose inner rim acts as an air discharge flap valve against the plunger stem. This arrangement dispenses air at all speeds and helps prevent liquid getting into the air chamber.

WO-A-97/13585 notes a tendency for such a double-acting valve element to stick, and addresses this by providing some axial play between the plunger stem and the air piston. This play is taken up in alternating directions as the plunger reciprocates, keeping the valve element moving freely.

EP-A-736462 is another system using axial lost motion between air piston and plunger, for a double-acting valve action via holes near the inner periphery of the air piston roof.

Our present proposals provide new and useful developments in various aspects of the construction of dispensers, particularly foam dispensers of the kind described. A first set of aspects is concerned with the venting and valving of air flows in relation to the air chamber. A further aspect relates to venting in plunger operated pumps in general. Other aspects relate to a new overall disposition of the pump parts.

A first proposal herein is that the plunger includes a cap shroud whose outer skirt continues down and connects fixedly or integrally adjacent the air piston's peripheral seal, defining thereby an internal cap air chamber above a roof of the air piston, enclosing the air inlet valve. Access for exterior air to the air chamber in the air cylinder is then via this internal cap air chamber. External air may enter the cap through one or more holes in the cap shroud e.g. holes above where the cap shroud projects through a guide opening of a fixed pump body.

A further independent but combinable proposal herein is that the air inlet valve through which air enters the air chamber comprises a radially inwardly-projecting flexible valve flap formed integrally with at least an outer sleeve portion of the air piston, carrying or including a seal portion shaped to engage the air cylinder wall. In a preferred embodiment this outer sleeve of the air piston is fixed directly to a cap shroud of the plunger which encloses the air inlet.

The air inlet valve flap, which preferably extends substantially in a radial plane and is preferably a uniform annulus, is flexible relative to an air inlet valve seat. A preferred valve seat is a downwardly-directed edge, especially an annular edge, of a core sleeve comprised in the pump plunger and which moves axially, preferably fixedly, with the pump plunger.

Desirably the components of the pump plunger are fixed together in pre-determined axial register so that the air inlet valve flap is resiliently urged axially against the air inlet valve seat, such as the annular edge of a core sleeve as mentioned. The air discharge passage may lead up inside such a core sleeve. The core sleeve may then also provide a valve seat for air outlet valve flap which is provided on a radially inner plunger core portion. Or, the core sleeve may itself comprise integrally an air outlet valve flap e.g. extending from at or from adjacent the seat edge engaged by the inlet valve flap. Thus, in one preferred embodiment the air inlet valve flap extends radially relative to, e.g. inwardly of, the core sleeve, and an air outlet valve flap extends radially (or at least, with a radial component) out towards or in from the core sleeve. Such a core sleeve preferably encloses an annular air discharge space, all or partly downstream of the air outlet valve when one is provided, and communicating (from downstream of any such outlet valve) inwardly (optionally also upwardly) to a mixing chamber for liquid and air. Such a mixing chamber and/or the point(s) of air injection into such a mixing chamber is preferably axially overlapped by the annular air discharge space in the core sleeve. This gives an axially compact construction.

The core sleeve in any of the other embodiments may be constituted by a downward skirt from a plunger component. This skirt may include a core part projecting down inside the core sleeve at a radial spacing. This inner core part might be for example a surround to a mixing chamber, through which the air is injected, and/or part of a plunger stem which is or carries the liquid piston.

A further proposal herein is that the air outlet valve is provided as an upwardly diverging conical or cup-shaped element, sealing outwardly against an inwardly directed air discharge passage wall, such as that of a core sleeve as mentioned above, or some other part of the air discharge passage. A benefit of this air outlet valve conformation is that it catches drops of liquid escaping from the foam-generating region and helps prevent them from reaching the air chamber.

Further aspects herein relate to modes for arranging the mixing of liquid and air. Typically the liquid discharge passage rises axially from the liquid chamber in the liquid cylinder. The liquid discharge passage may extend up inside a hollow stem inside the plunger. A liquid discharge valve is usually provided for this passage. We prefer to provide the valve at the entrance to the passage e.g. by means of a sliding seal on the liquid piston which covers and uncovers windows in the hollow stem However, it would also be possible to provide a liquid discharge valve midway along the liquid discharge passage, as in the prior art patents mentioned above. Preferably a mixing chamber or region where air and liquid are present together is provided immediately upstream of the foam-generation element. We prefer that at or immediately before this mixing chamber the liquid discharge passage diverges around a central baffle or block, either freely in a chamber or along one or more restricted diametrically-spaced passageways in parallel. The airflow from the air discharge passage may impinge on this diverged or distributed liquid flow in order to promote mixing.

We prefer that the air discharge passage opens to the region of mixing with the liquid, e.g. into a mixing chamber, with a substantial radially inward direction component. Optionally, it may also have a tangential component. We particularly prefer that the air discharge passage has a circumferentially distributed air injection locus e.g. surrounding or opposed across the liquid flow. There may be plural (for example at least two or at least three) air injection points at the combination with the liquid flow. The liquid flow may rise as a generally tubular curtain from a generally annular slit forming an outlet of the liquid discharge passage.

The preferred foam-generating element uses one or more layers of mesh to produce a uniform foam for discharge. The nature of the mesh is not critical: we prefer a coarser mesh followed by finer mesh. These meshes may be provided on a foam-generating module in which discs of the meshes are bonded across the open ends of a short tube which can be fitted into a complementary housing recess of the plunger during assembly.

A third aspect of the present proposals relates to a novel disposition of the discharge passageways. In this aspect the pump has a fixed discharge nozzle arrangement beside the reciprocable plunger. The air and liquid discharge passages leave the respective chambers at or adjacent their bottoms, and the foam-generating element is fixed in or beneath the fixed nozzle component, instead of being in the plunger as in prior art designs. There is obvious user benefit in having a foaming dispenser whose discharge nozzle does not move during dispensing. The necessary topology of discharge passages can be created with injection-moulded components using a moulded discharge-passage forming lower shell which fixes on to the pump below the cylinder-forming component(s).

In all of the above aspects it is preferred that the air cylinder and liquid cylinder be concentric. It is also preferred, as in the prior art, that they are formed together in one piece of plastics material. The cylinder-forming component(s) can be secured into a container neck either directly, e.g. by having its own downturned rim with appropriate securements (thread or snap ribs), or indirectly by means of a discrete retaining collar having such securements.

A further aspect may relate to the first proposal above, i.e. venting for the air cylinder of a foam dispenser via the cap shroud, but is also independently applicable in general in pumps which have a pump body secured to the top of a product container, e.g. integrally or by means of a screw or snap cap, and the pump is operated by a plunger which works reciprocally in or on the pump body to alter the volume of a pump chamber communicating via an inlet valve with the container interior and—usually via an outlet valve—with a discharge opening. Usually the plunger carries a piston working in a cylinder provided by the body, although it can be the other way around. The discharge opening may be on the plunger (moveable nozzle pump) or on the body (fixed nozzle pump).

In any event there is a general need in dispenser pumps of this kind to allow air into the container or pump to compensate a volume dispensed.

One conventional product vent arrangement provides one or more small vent holes through the cylinder wall near the top. Air can enter the pump body through the clearance between the plunger stem and the surrounding collar of the body cap and into the container space via the vent holes, which are above the piston seal. In other known constructions the vent channel bypasses the cylinder interior e.g. by means of a channel between a closure cap and the container neck to the container interior, or a channel from the above-mentioned clearance around the stem which skirts around the top of the cylinder wall. A further possibility is to vent air inwardly through a hole or channel in the plunger head itself rather than through an annular clearance between plunger and collar.

While conventional venting relates to compensating for volume of dispensed product, there may be other needs for venting air. In particular, foam dispensing pumps as described herein are adapted to dispense foam by pumping simultaneous flows of air and liquid to some mixing location in the pump. In this case there is a need to admit air to the pump system for pumping to form foam, and the volume of air required is likely to be greater than the volume required for compensating dispensed liquid product volume. We particularly envisage use of the present proposals for air venting in such a foaming dispenser or in conjunction with other plunger-operated foam dispensers which pump air and liquid together in the manner referred to above.

Known foam dispensers admit air for pumping by various routes, including some of those mentioned above.

There are special difficulties when a dispenser has to be used in a wet environment, e.g. outdoors in the rain, or especially indoors in a shower. Water has a tendency to get in or be drawn in through the air vents, particularly where these are between the plunger stem and collar surround because water can lie in the gap. Water getting in this way can contaminate or dilute the product in the container. In a foam dispensing pump it can accumulate undesirably in the air pumping system.

What we propose in this aspect are new arrangements for venting air via an opening in the shroud or casing of a pump plunger, and particularly where the plunger (e.g. the mentioned shroud or casing thereof) makes a close or sealing fit through the collar or other top opening of the pump body so that venting there is prevented or is insufficient. What we propose is to provide a cover element overlying one or more vent opening(s) of the plunger casing. Preferably this cover element is a discrete second element which is clipped or snapped onto or into a first element of the plunger casing. Access to the opening(s) through the plunger casing is or is via a venting clearance defined between the cover element and the plunger casing. Entry to this access clearance may be via one or more entry openings defined on one side by the edge of the cover element.

The opposed surfaces of the casing and cover element may define between them one or more elongate and/or tortuous channels or clearances leading from the entry opening(s) to the opening(s) which open(s) to the interior of the casing. To provide elongate and/or tortuous channels or clearances, the surface of a discrete cover element and/or of a first plunger casing element can be formed with grooves or open channels or other recesses which become closed channels or clearances when the cover element and plunger are assembled together. When they are discrete components, it is simple to form non-straight (bent or curved) channel or clearance shapes by moulding.

It is strongly preferred that from the entry opening(s) the access path between the cover element and plunger casing leading to the opening(s) through the casing is at least partly uphill. The path(s) may be for example uphill at least from the entry opening(s). Additionally or alternatively it is uphill over most or all of its length. This helps to drain away any water which may get into the venting clearance.

The cover element may be laminar. It may for example be a simple single layer with integral fasteners such as snap pins or pegs by which it is secured to the main plunger casing.

A particularly preferred position for the cover element is on top of or as the top of the plunger. It may extend to a lateral extremity of the plunger, e.g. to the side and/or a rear face, and have the entry opening(s) there to reduce the chance or water collecting at the vent. In a preferred embodiment the top of the plunger slopes down to the rear and the cover element provides or is on the sloping region, with one or more entry openings at the rear of the plunger below the rear edge of the cover element. One or more elongate and/or tortuous vent channels may be defined between a plunger top surface of a first element and the cover element. Such channel(s) might extend forwardly up that top surface, and one or more corresponding holes through the wall of the first element and into the plunger interior towards the front. In this embodiment the cover element may be presented as a finger grip push button finish for the plunger. It may be outwardly concave.

Or, the one or more vent channels may open to the plunger interior at an opening also defined between the cover element and the first plunger element. Indeed the whole channel may be defined between opposed surfaces of such elements, to take advantage of the ease of forming complicated internal moulded shapes between opposed surfaces of discrete components.

There are cosmetic advantages to providing the entry opening(s) between the plunger casing and the edge of the cover element, because the existence of the boundary distracts the eye from the opening. Nevertheless it is in principle possible to provide the entry opening through a first, inner element plunger casing only, and lead it to the interface between the casing and cover element, again to take advantage of the ease of making a more tortuous—and hence less water-penetrable—vent passage between two elements.

The present proposals are particularly useful where the plunger casing extends down as a continuous shroud into the pump body opening, particularly with a sealing fit. Such a shroud or cap may enclose an interior plunger cavity. We also envisage, where the plunger houses a hollow discharge channel of the pump leading to a nozzle, that the channel formation of one or more vent passages as mentioned above may extend alongside e.g. to either side of the discharge channel wall at the top of the plunger. From the interior of the plunger, the route for vented air is not particularly restricted. For example in a foam-generating dispenser it may pass down inside the plunger to an air intake valve for an air cylinder, which may be the only other opening from this interior space of the plunger.

A further embodiment has a plunger cap having an upwardly open, generally tubular lower element and the cover element as a top lid or closure which defines at least part of a discharge channel e.g. nozzle for the pump, at the same time as defining between it and the lower element a vent channel or vent channel entry according to any of the proposals previously outlined, when the elements are fitted together e.g. with the top lid plugging the lower element. The top lid may also provide a core sleeve or core sleeve portion as referred to previously, preferably as a one-piece integral downward extension.

Embodiments of the invention are now described by reference to the accompanying drawings, in which.

Figure 14:
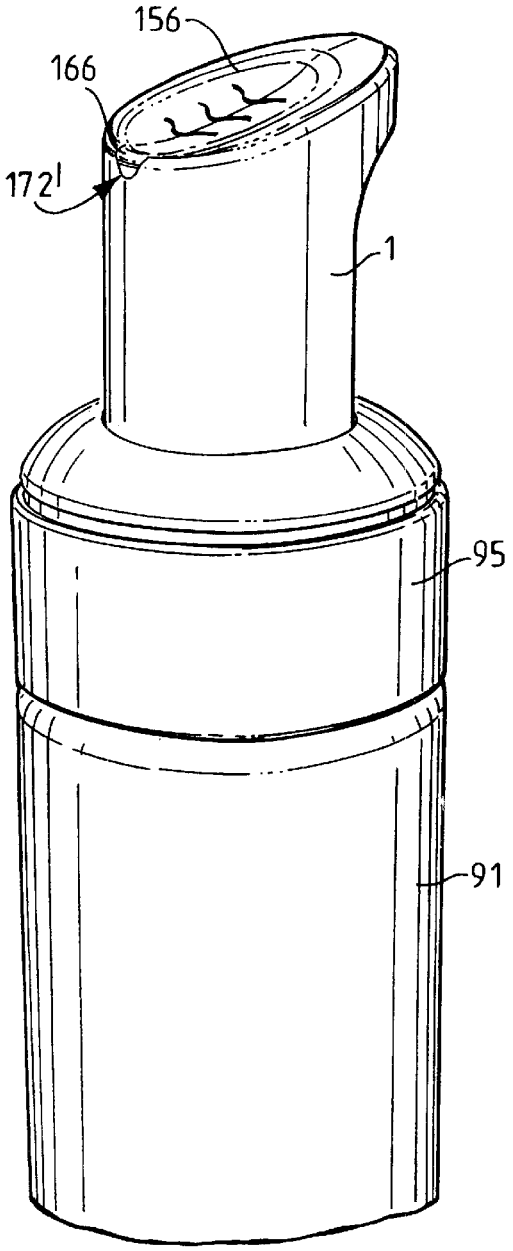
FIGS. 14 and 15 is similar but with the vent cover removed.
Figure 15:
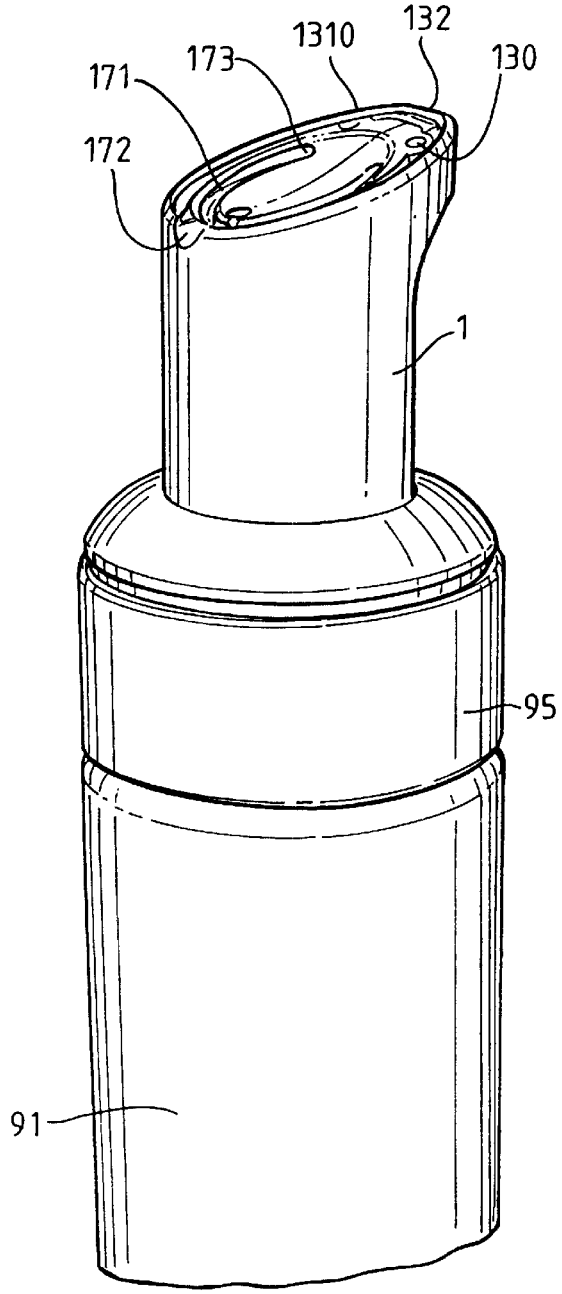
Figure 16:
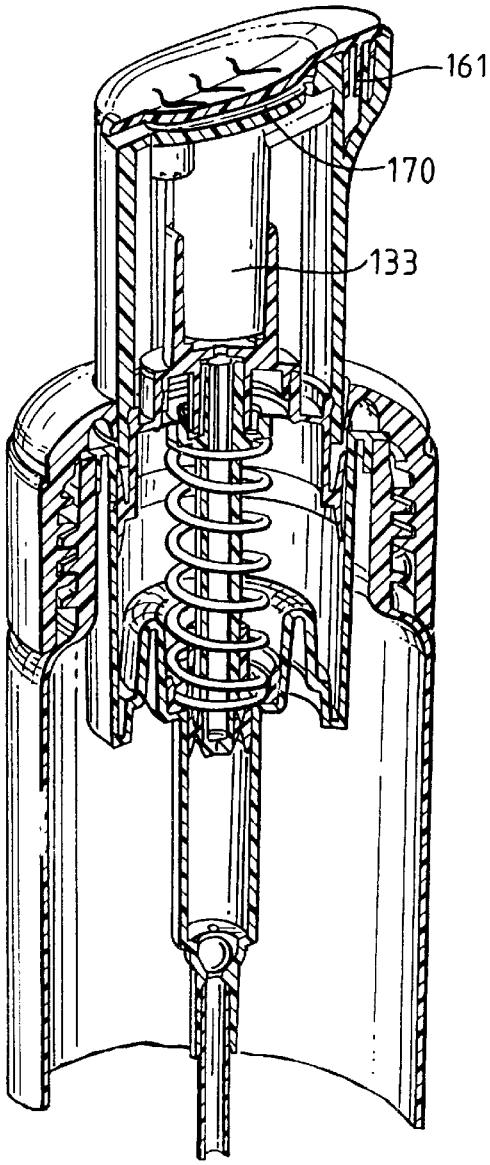
Figure 17:
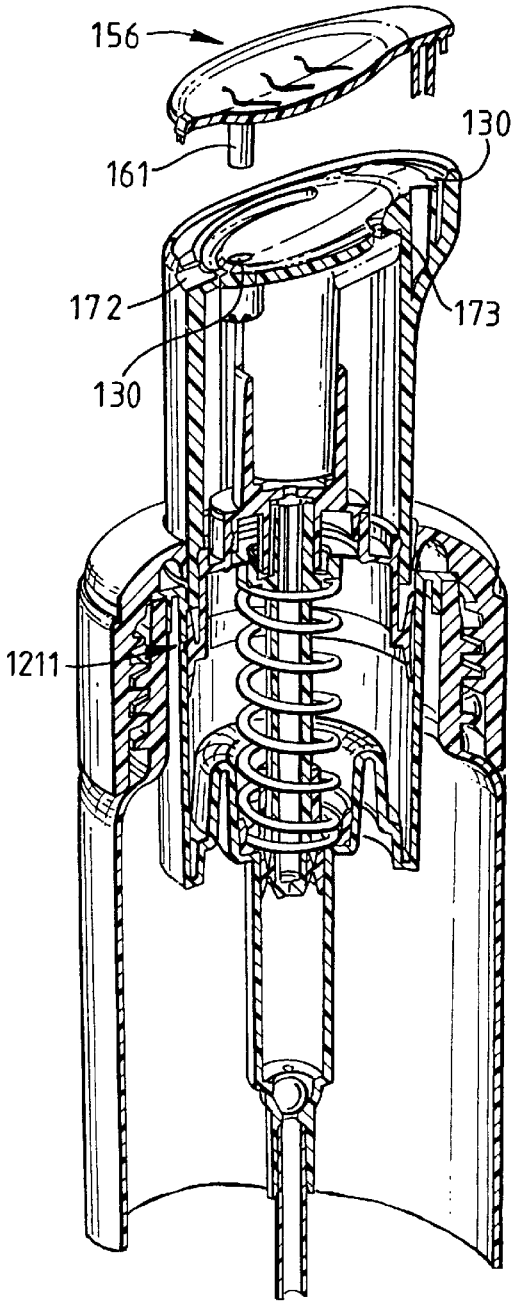
Figure 18:
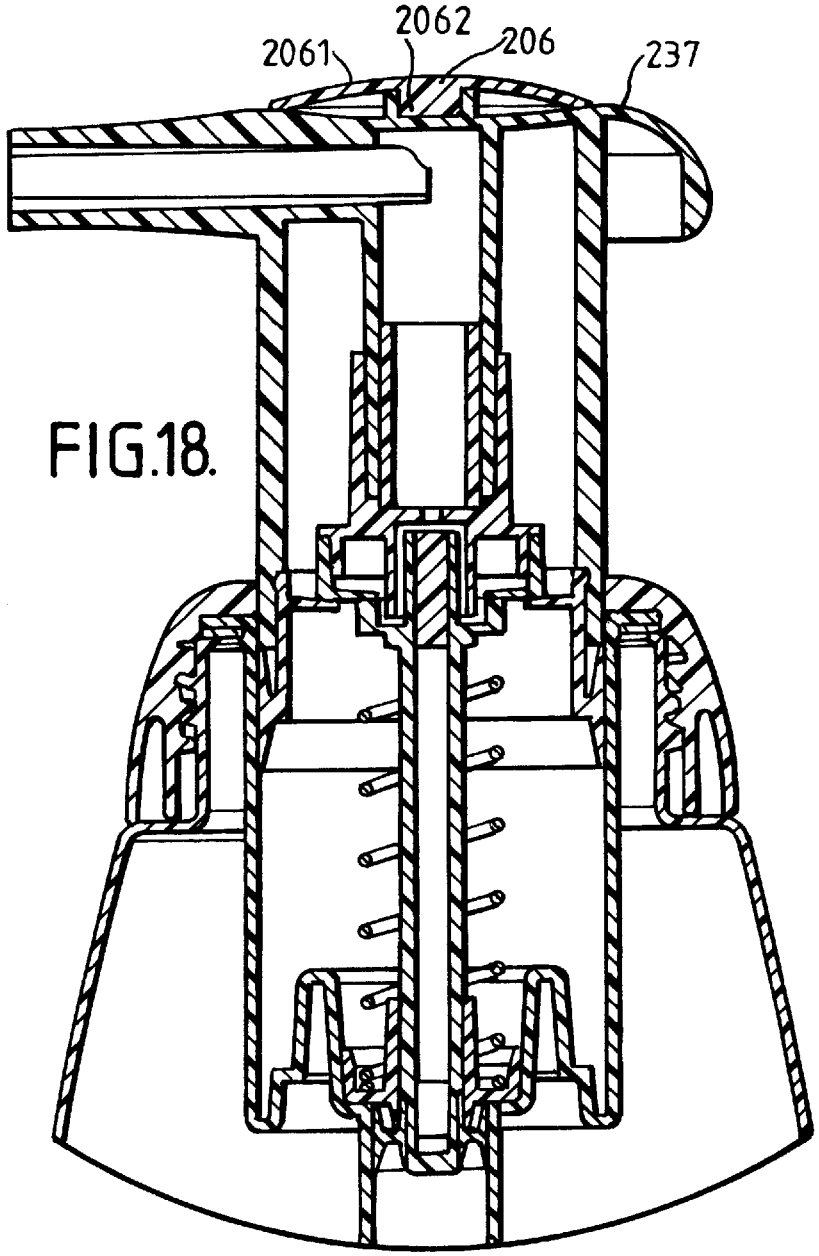
Figure 19:
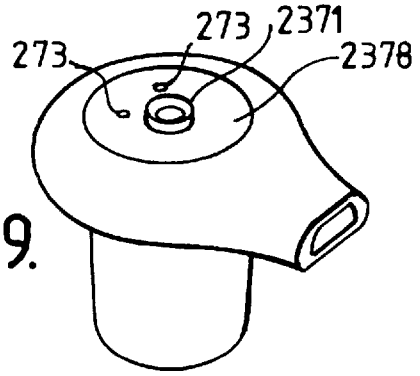
Figure 20:
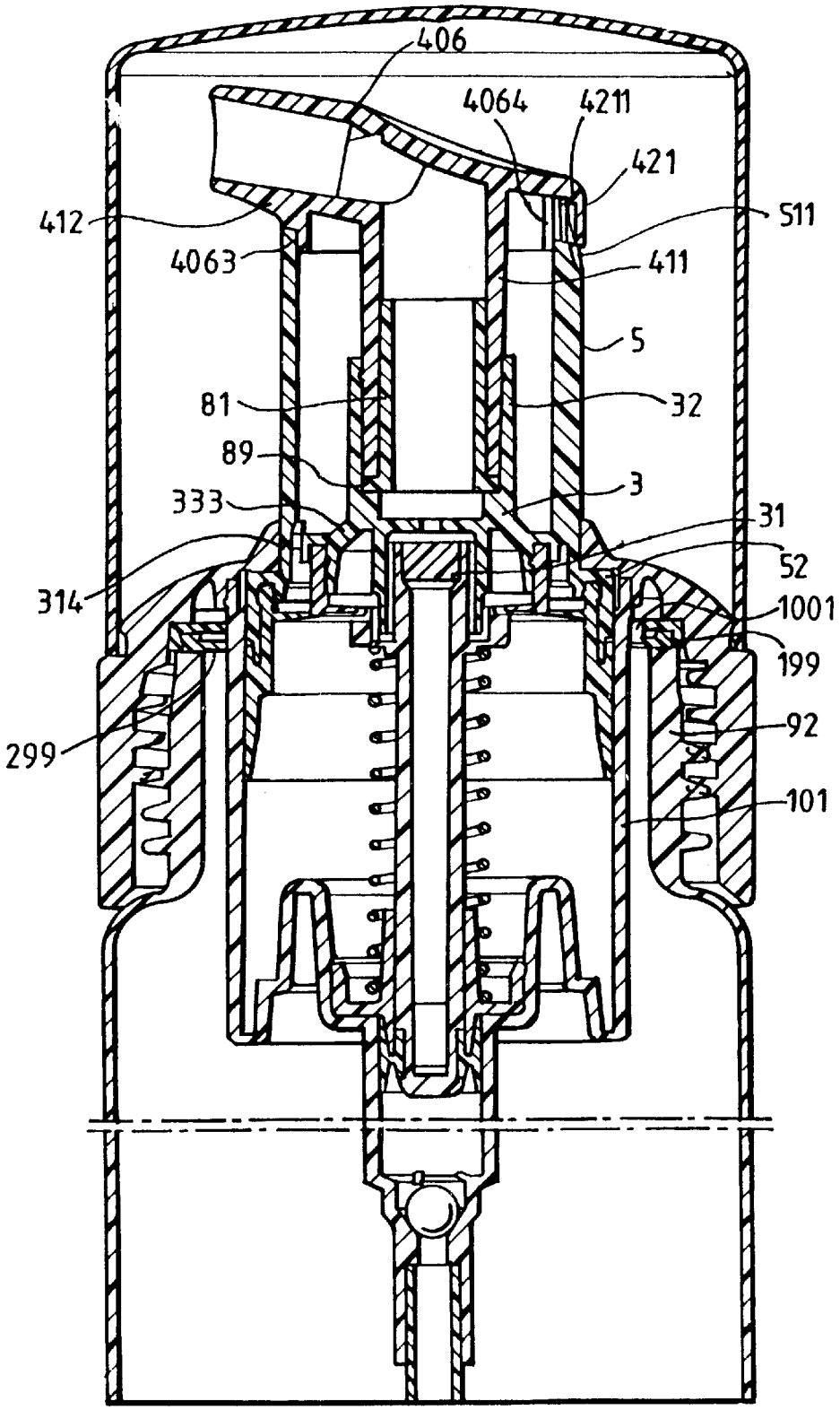

FIGS. 16 and 17 correspond to FIGS. 14 and 15 with the pump components axially sectioned;

FIG. 18 shows in axial cross section the top of a sixth embodiment of dispenser, also having a vent cover;

FIG. 19 shows the top of the main plunger component of the sixth embodiment with the vent cover removed; and FIG. 20 shows a seventh embodiment of foam dispenser.

FIGS. 1 to 4 show a first embodiment of hand-operated foam dispenser. The dispenser is mounted on the threaded neck 92 of a conventional blow-moulded cylindrical container 91. The container need not be cylindrical, however. As is already familiar for people skilled in this field, the dispenser includes a one-piece cylinder component 10 e.g. of polypropylene. This includes a lower, smaller-diameter liquid cylinder 102 and an upper larger-diameter air cylinder 101, with a side vent hole 109. The cylinder component 10 is recessed down into the neck 92 of the container and held in place by a threaded retaining collar 95. At the bottom end of the liquid cylinder 102 a valve seat 104 is integrally formed, also a socket for a dip tube 94. These are conventional features.

A plunger 1 is mounted to act reciprocally in the air and liquid cylinders 101, 102. The plunger has a projecting central stem 13 carrying a piston seal 41 which works in the liquid cylinder 102. A tubular piston-retaining insert 105 is snapped into the base of the air cylinder 101 and the liquid piston seal 41 is trapped beneath it; this keeps the plunger in the assembly. A return spring 93 is fitted around the plunger stem 13—in the air chamber 16 so as to avoid spring corrosion—and acts to urge the plunger 1 to its uppermost position.

Figure 2:
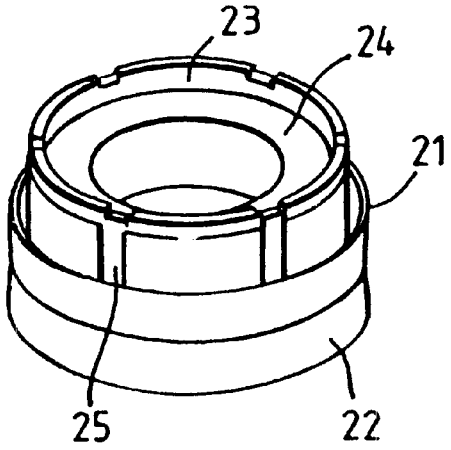
FIG. 2 is a perspective view of an air piston seal component thereof.
Figure 3:
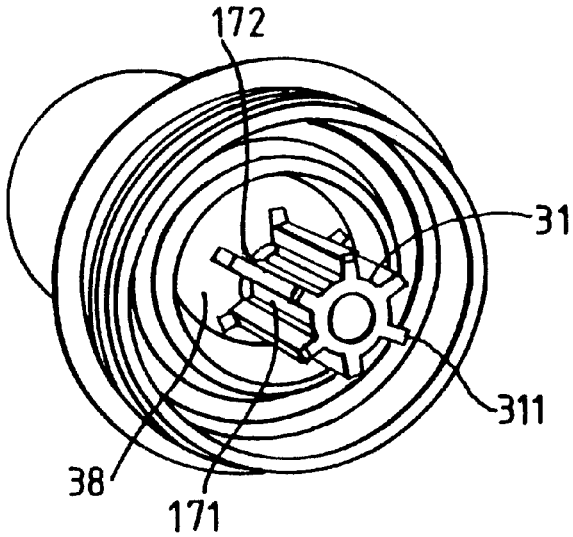
FIG. 3 is a perspective view of a plunger core component thereof.
Figure 4:
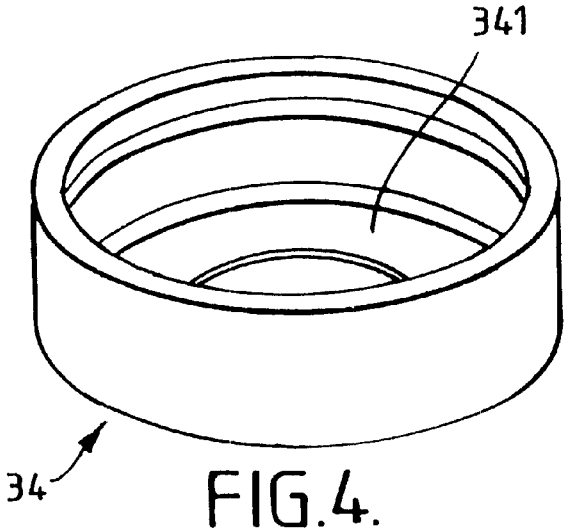
FIG. 4 is a perspective view of a plunger core sleeve extension incorporating an air outlet valve.

The air piston 2 surrounds the upper part of the plunger stem 13. Unlike prior art constructions, it is not retained and driven by engagement at the plunger stem but rather by a snap fitting engagement into the lower end of a cap shroud 5 of the plunger. This cap shroud 5 is of substantially the same diameter as the air cylinder. The discrete air piston component is shown in FIG. 2 and is a generally cylindrical sleeve 23 having a snap rib at the top to locate it at a predetermined degree of axial insertion into the cap shroud interior. An outwardly-directed sealing lip 21,22 towards its lower end acts against the air cylinder wall. Thus, pressing down the plunger 1 directly (without play or lost motion) operates the air piston 2 in its cylinder. Projecting radially inwardly from near the top of the sleeve 23 is a radial annular valve flap 24 tapering in thickness towards its edge.

Considering now the central parts of the plunger the nozzle 12 communicates with an inner axial downwardly-open tube 11 which forms a top foamer unit housing. This tube 11 snap fits into an upwardly-open cylindrical tube 32 of a core insert component 3, trapping in the space between them a foam-generation element 8 in the passage leading to the nozzle 12. This foam-generating element 6 has conventional features, being a cylindrical plastics tube 81 fitting closely in the housing tube 11 and having ultrasonically welded across its open ends a disk of coarse nylon mesh 82 (bottom end) and fine nylon mesh 83 (top end).

The snap fit between the tubes 11, 32 involves snap ribs that fix the relative axial positions of the plunger cap 5 and the insert core 3.

Below the foam-generating element 8 the core insert 3 (see also FIG. 3) defines a small circular mixing chamber 180 above a floor 38. Projecting down from the centre of this floor 38 is a hollow cylindrical stud 31 with a set of axial ribs or splines 311 which fit closely, again with a snap fit, into the slightly enlarged top-diameter of the hollow plunger stem 13. This connects the plunger top to the liquid piston 41, and at the same time blocks the exit of the liquid discharge passage 15 except for a set of narrow axially-extending peripheral channels 171 extending up between the splines 311 and the stem wall and passing through the floor 38 of the insert core component 3, via holes 172 which are stepped slightly radially inwardly from the openings 171 along between the splines 311.

The enlarged diameter section at the top of the stem 13 is dimensioned so that when the splined stud 31 fits right into it, its top edge has a clearance from the underside of the core insert's floor 38. This clearance thus communicates with the passages 171 between the splines, immediately before where they pass up through the floor 38.

Figure 1:
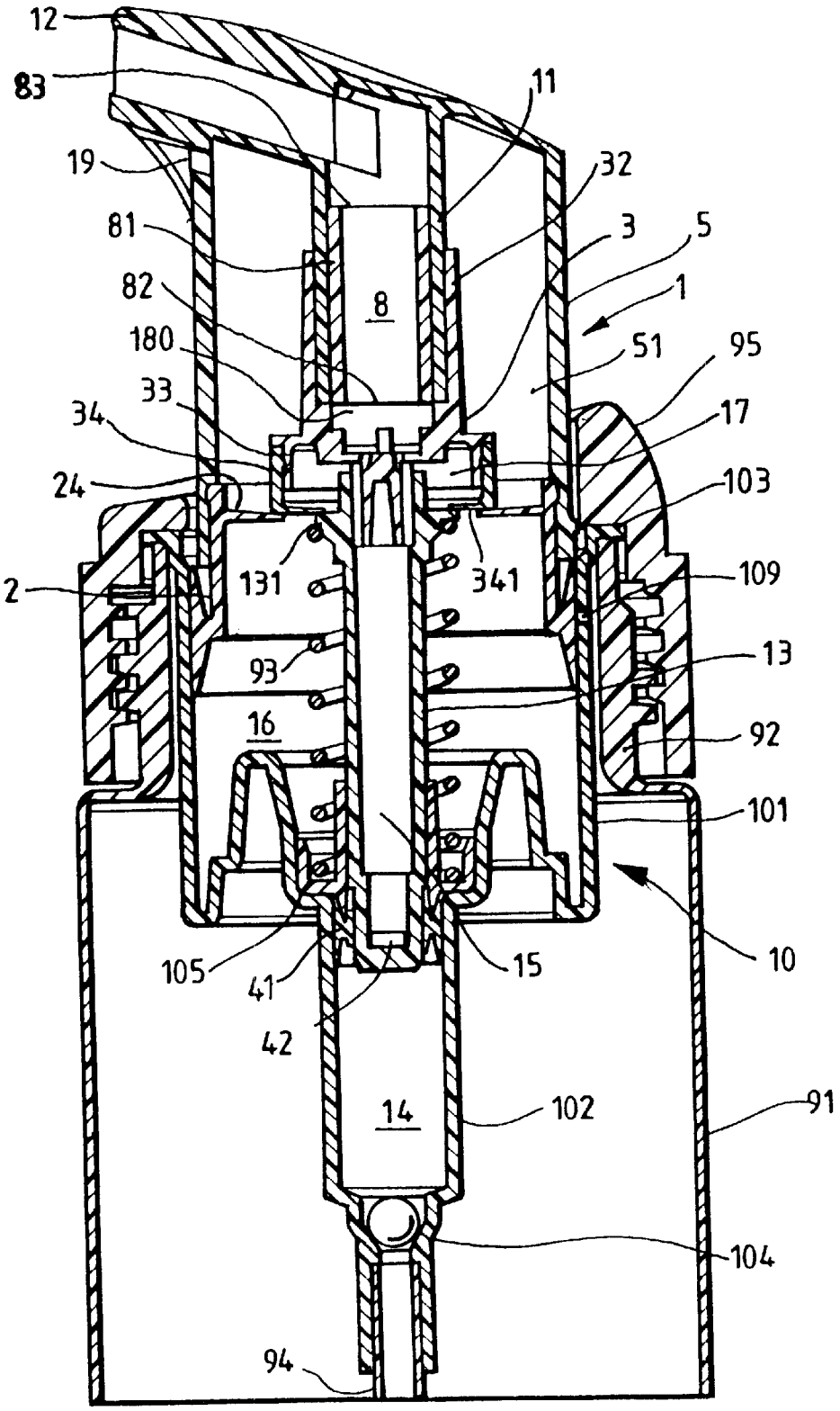
FIG. 1 is an axial section of a first embodiment of a dispenser pump.

Projecting integrally at the lower end of the core component 3 is an outward radial flange with a downward cylindrical skirt or core sleeve 33. Around this in turn is snap-fitted a generally cylindrical core sleeve extension 34; see FIG. 4. Projecting radially in perpendicularly from the bottom edge of this extension 34 is an integral valve lip 341 of progressively decreasing thickness. The bottom of the edge of this lip rests on an annular valve seat ledge 131 extending around near the top of the plunger stem 13, as seen in FIG. 1. An annular air discharge chamber 17 is thereby defined between the top of the stem 13, the core sleeve extension 34 and the core floor 38. There is a way into this annular air chamber 17 from the air cylinder chamber 16, by means of displacing the valve lip 341 upwardly. There are six ways out of the air discharge chamber 17, via the small radially-inward passageways referred to above and up into the mixing chamber 180.

It will be noted that in this embodiment the piston seal 41 of the liquid piston is of the "sliding seal" type which acts as a discharge valve at the entrance to the liquid discharge passage 15. That is to say, on the downstroke of the plunger the sliding seal 41 is displaced upwardly relative to the plunger stem 13 and uncovers the plunger stem windows 42, allowing liquid to flow under pressure from the liquid pump chamber 14 into the liquid discharge passage 15 and up to the narrow discharge passages 171 between the insert splines 311.

The action of the pump on pressing down the plunger is as follows. At the same time as liquid is driven up passage 15 as mentioned, air in the air chamber 16 is forced—by the decrease in volume of that chamber—through the air outlet valve flap 341 into the air discharge chamber 17 and radially in from all directions to mix vigorously with the rapid and distributed upflow of liquid. The liquid and air flows mix as they enter the mixing chamber whence they pass through the progressively decreasing meshes and merge as foam from the nozzle 12. The one way action of the air inlet valve flap 24 prevents escape of air from the chamber 16 by that route as the plunger is depressed.

Conversely, as the plunger rises again under the force of the spring 93, the liquid chamber 14 is primed in the conventional way via the inlet valve 104. Air flows in to occupy the air chamber 16 by downward displacement of the air inlet valve flap 24 relative to its valve seat (the bottom edge of the core extension 34) under the prevailing pressure difference. At this time the resilient sealing of the outlet valve flap 341 prevents any liquid from dripping through into the air chamber Air flows into the air chamber 16 from the cap air apace 51 inside the cap shroud 5 which encloses the inlet valve 24. In turn, air may enter the cap air space 51 via channel clearances between channels 25 of the air piston insert sleeve 23 and the bottom rim of the cap shroud 5. Alternatively and preferably, air may enter the cap shroud 5 via an upper opening 19 in the shroud itself (see FIG. 1), the air piston sleeve being connected air tightly.

The skilled person will appreciate that the in-plane disposition of the two flap valves, each formed integrally with another functional component and one using the other's component as its seat, is a very neat, compact and component-economical way of providing the air-valving, which is always a vexed issue in pumps of this type.

Figure 5:
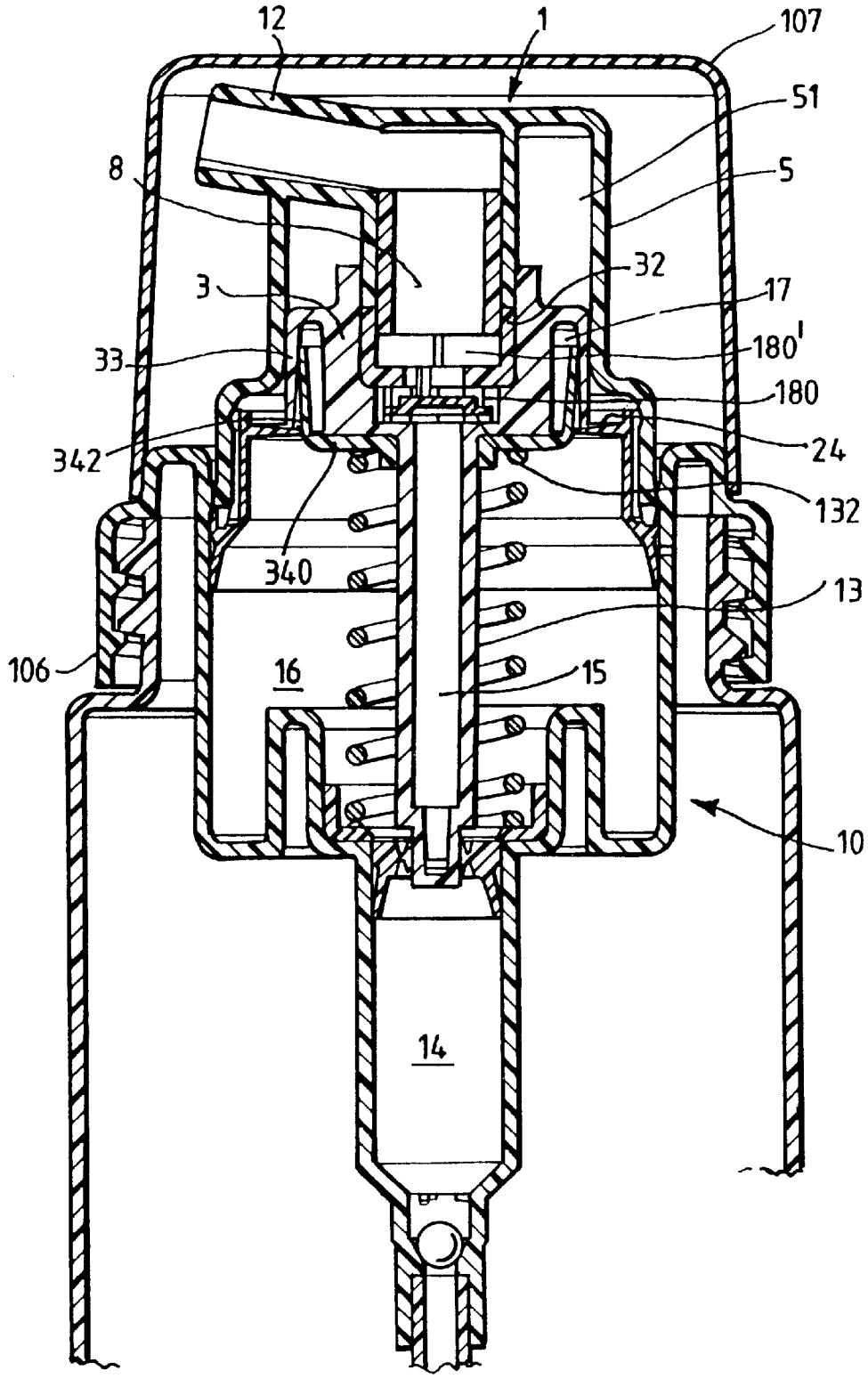
FIG. 5 is an axial section of a second embodiment of dispenser pump.
Figure 6:
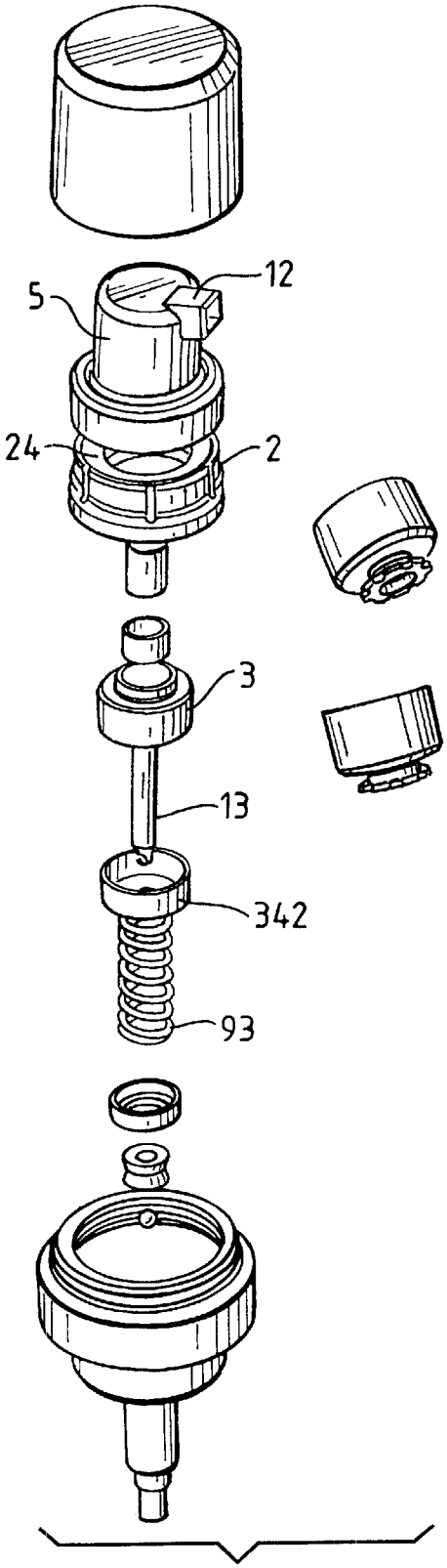
FIG. 6 is an exploded view of the pump components.
Figure 8:
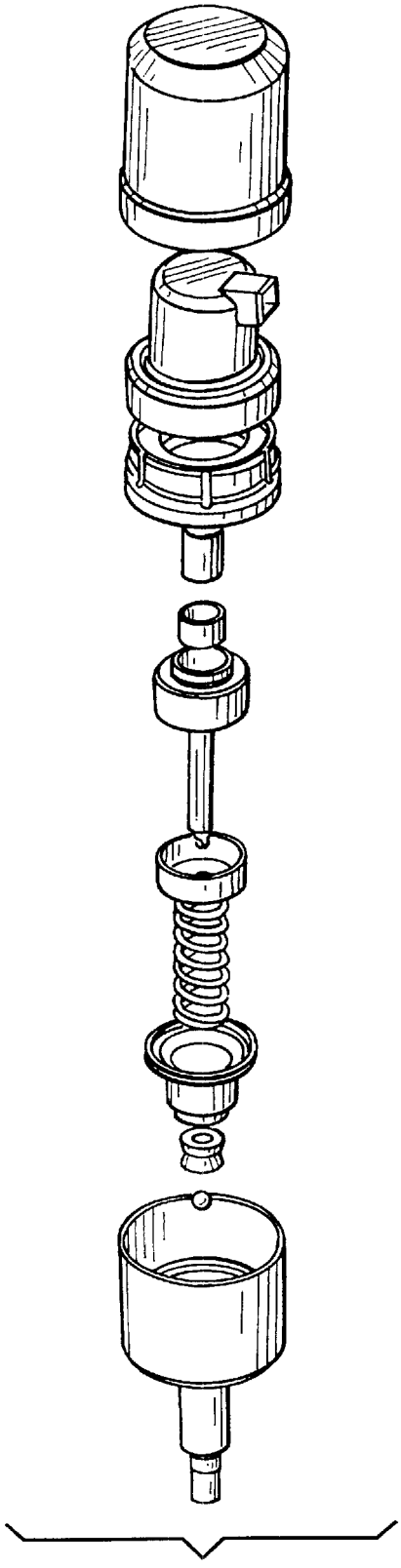
FIG. 8 is an exploded view of the components of the third embodiment.

FIGS. 5 and 6 show a second embodiment which in many respects is similar to the first. Analogous components are numbered similarly. One difference here is that the top of the cylinder component 10 is bent right over and round as a threaded retaining collar 106 in one piece with the cylinder component 10. Another difference in this embodiment is in the formation of the core component 3 and its interaction with the air outlet valve 342. Here the core component 3 is a one-piece integral whole including the hollow piston stem 13, a generally cylindrical body containing the mixing chamber 180 for the air and liquid and defining a cup which holds the housing tubes for the foam-generating element 8, as well as the radial flange and downward cylindrical core sleeve 33. Here the mixing chamber 180 is recessed down inside the core 3 and is fully overlapped axially by the annular radial space 17 in between the body of the core 3 and its outer core sleeve 33. The air piston 2 and its integral inlet valve flap 24 are generally similar to those in the first embodiment although the cap shroud 5 of the plunger is differently shaped being narrower at the top. The inner edge of the inlet valve flap 24 makes its sealing engagement against the terminal edge of core sleeve 33 as a valve seat, as in the first embodiment. However in this embodiment the air outlet valve is not formed integrally with the core sleeve 33. Rather, it is a discrete cup-shaped component with a base 340 fitting up around the stem 13 beneath the core 3, and having a conical, upwardly outwardly divergent sealing lip 342 which projects up into the air discharge chamber 17 within the core sleeve 33 and bears against the inwardly directed surface of the core sleeve 33 which is then the valve seat.

The components are dimensioned and their snap positions determined so that the resilient air inlet and outward valve lips are lightly biased, i.e. deformed against their resilience, against their valve seat surfaces. This assures a positive action.

Figure 9:
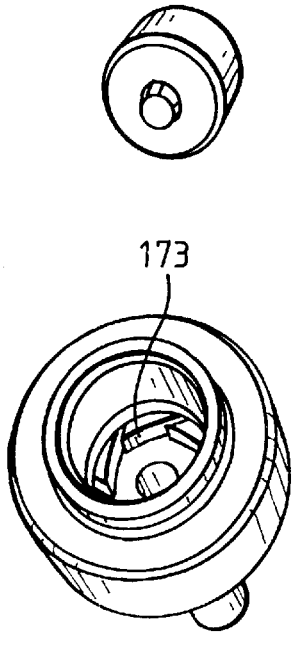
FIG. 9 is a perspective view from the top of a plunger core component in the third embodiment.

The air passages leading from the air discharge chamber 17 into the mixing chamber 180 are not shown in the section of FIG. 5, but can be seen in the view of the corresponding component in FIG. 9. They are provided as a series of tangentially-inclined radially-extending slots leading in through the central boss of the core 3 and from the space 17 into the chamber 180 at the same axial level. A further difference in this embodiment is that the baffle 132 (formed as a disk 132 with a serrated edge: see FIG. 6) projects freely into the centre of the mixing chamber 180 and does not project into the top of the liquid discharge passage 15. Liquid rising from the discharge passage 15 strikes the baffle 132 directly and is scattered for mixing with the radially/tangentially impinging air streams. Prom there the air/liquid mix rises through a hole into an upper part 180' Of the mixing chamber, inside a lower foamer housing tube 32 formed integrally with the baffle disk 132, thence to pass through the foam unit 8.

The reader will readily appreciate the action of the air outlet valve 342 as the plunger 1 is depressed. The outlet valve lip 342 is urged by the air pressure in the chamber 16 away from its seat. Should any liquid escape from the mixing chamber 180 it is retained in the cup-shaped valve element 340,342 and does not get into the air chambers 16. The economy of parts is again excellent. Air reaches the air cylinder through the cap air space 51 and the air inlet valve 24. Access to the cap air space may be through a set of channels between shroud and air piston 2, as in the first embodiment, or through a hole 19 in the top of the shroud as mentioned previously.

FIG. 5 also shows an outer cover cap 107 (a similar cap used for the FIG. 1 embodiment has not been shown) for shipping.

Figure 7:
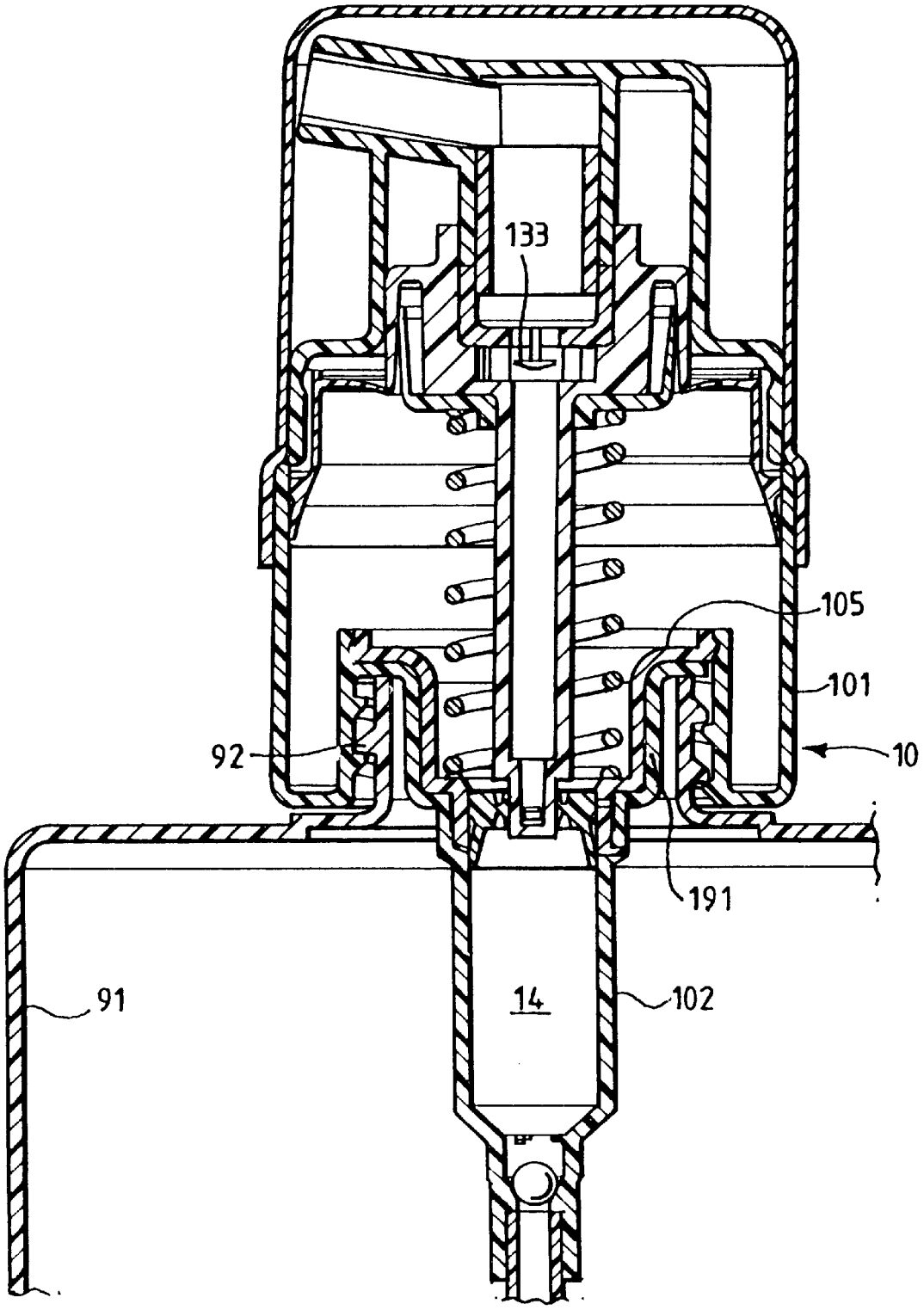
FIG. 7 is an axial section of a third embodiment of a dispenser pump.

FIG. 7 shows a third embodiment in which the conformation of the pump core 3 and the air inlet and outlet valves is essentially the same as the second embodiment above. A slightly different form of baffle 133 is used.

The difference in this embodiment is in the structure and disposition of the cylinder-forming parts of the pump. Unlike the wide threaded neck 92 of the first and second embodiments, the container 91 in this embodiment has a more standard narrow neck and the pump is specially designed to fit on it. To achieve this the air cylinder 101 is constructed so that the deep peripheral trough, down into which the piston seal slides, fits down around the outside of the neck and is internally threaded to engage it. The liquid cylinder 102 is still formed in one piece with the air cylinder 101, and is the only part projecting down inside the neck. This constructions which at the expense of some extra vertical height enables use of a dispenser of the present kind on a standard-neck container, brings an extra issue of venting into the container. In the previous embodiments the vent hole 109 is through an upper part of the side wall of the air cylinder 101, and valved by alternate covering and uncovering by the air piston (as is known in the prior art). In this third embodiment the air cylinder does not share a wall with the container's internal space, so instead a vent passageway is defined (by means of surface grooves) between the piston-retaining insert 105 and a transitional section of the cylinder component 10 between the air cylinder and the liquid cylinder portions. Compensation air can reach this vent channel 191 via the threaded engagement between the cylinder component 10 and the container neck 92.

Figure 11:
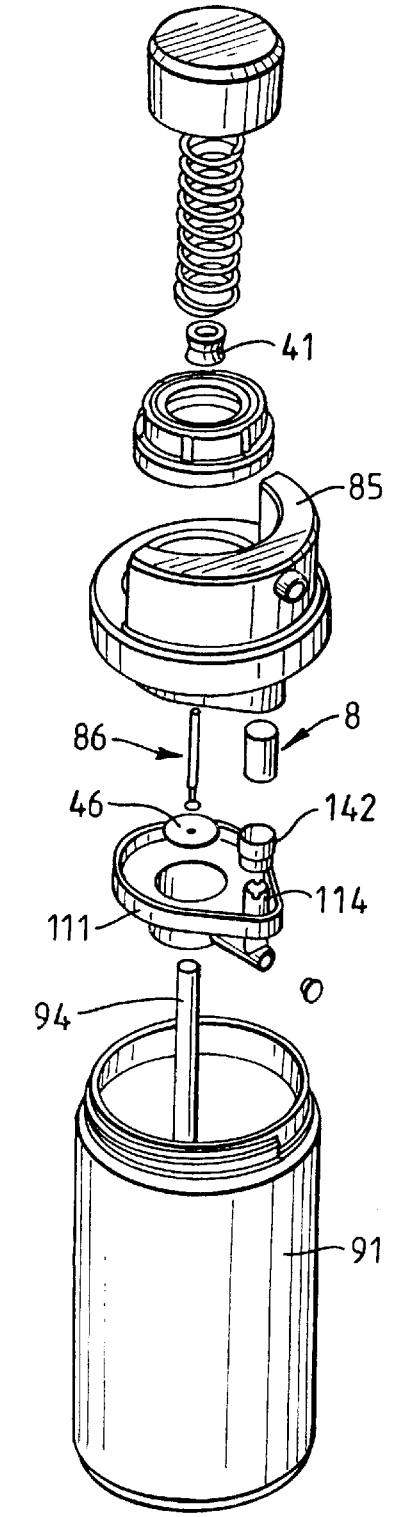
FIG. 11 is an exploded view of the components of the fourth embodiment.
Figure 10:
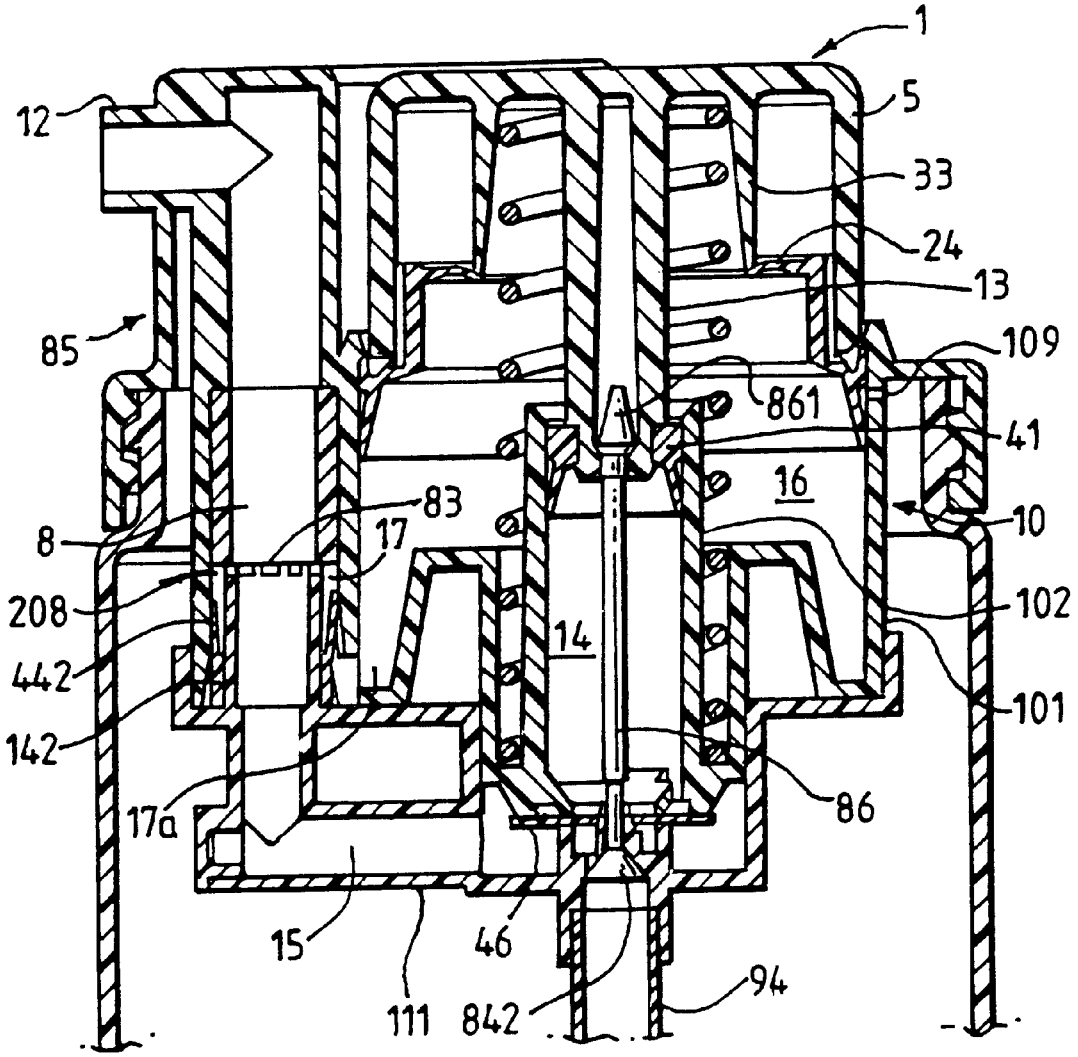
FIG. 10 is an axial section of a fourth embodiment of dispenser pump having a fixed nozzle.
Figure 12:
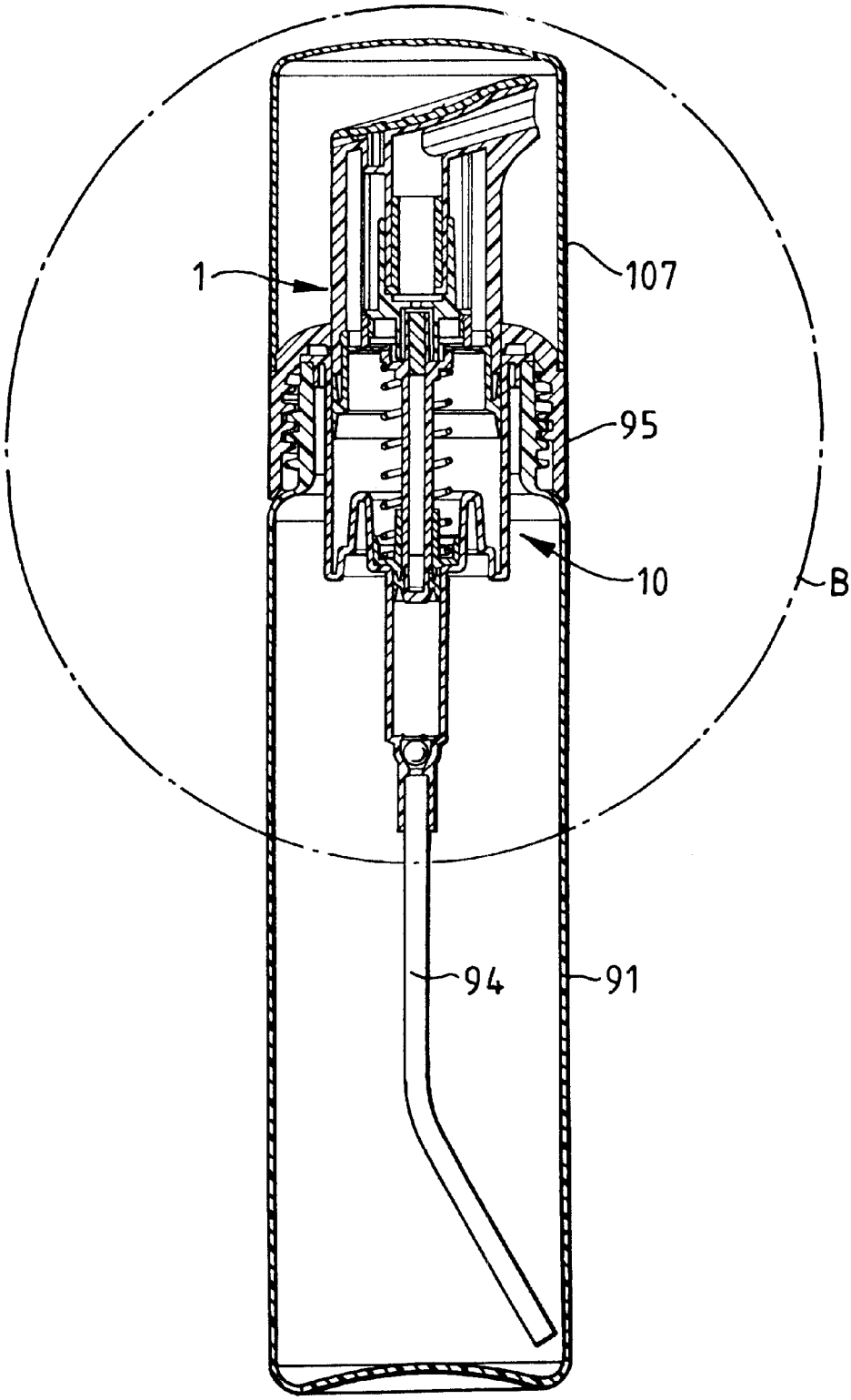
FIG. 12 is an axial cross-section of a fifth embodiment of foamer having a discrete vent cover.
Figure 13:
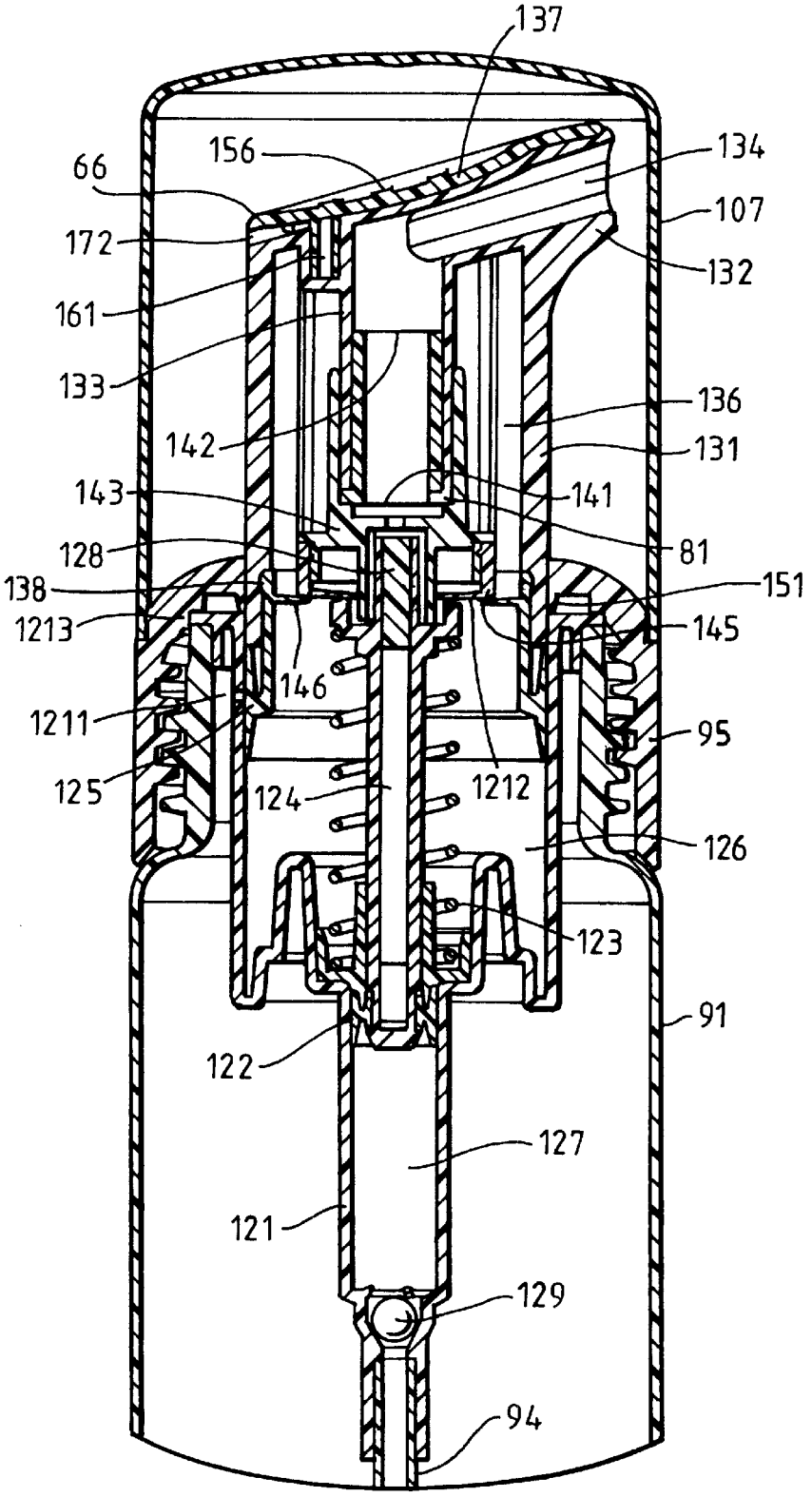
FIG. 13 shows enlarged the FIG. 12 embodiment at region B.

FIGS. 10 and 11 show a substantially different embodiment in which the discharge nozzle 12 remains fixed in relation to the container 91 during dispensing. This is achieved by leading the air and liquid discharge channels 15,17*a* out of their respective cylinders within the container interior, and leading them up alongside the pump body in a fixed pump body discharge module 85.

The plunger 1 carries a simple top button shroud 5 in which the piston stem 13 and the core sleeve 33 protect down concentrically with one another, integrally from the top web of the cap shroud 5. Because there is no need to accommodate the discharge arrangement in the plunger, and in order to minimise the axial height of the arrangement, the liquid cylinder 102 is brought up inside the air cylinder 101 (although still concentrically and in one piece with it), and the liquid piston seal 41 on the end of the stem 13 is a simple one, no longer needing to form any valve.

Enclosed valved passageways can be formed using moulded components by means of a lower basin component 111 clipped around the bottom of the cylinder component 10. The passageways are formed between shaped opposed surfaces and walls of these components. At the foot of the liquid chamber 14 a flexible valve disc 46 is trapped between the components 10, 111 and provides an outlet flap valve for the liquid leading into the liquid discharge passage 15. This passage is defined initially through a radial tube of the basin component 111 and then up through an axial side tube having a crenellated top opening immediately below the foam generating module 8. The air cylinder 101 is formed in one piece with the fixed discharge passage module 85, and the two communicate via an air discharge opening 17*a* near the bottom of the air cylinder 16. Here it meets the liquid discharge tube rising towards the foam-generating meshes. An air outlet valve component, in the form of a sleeve with a conically-divergent flexible upper part, fits around the liquid discharge tube at this point in an annular air discharge space 17. Thus, air driven from the air chamber 16 on pressing the plunger 1 passes the outlet valve lip 442 and mingles with the upflow of liquid via the crenellations at a mixing zone 208. The formation of foam as essentially as previously. The function of the air inlet valve 24 contained within the plunger is also the same as previously, although the plunger construction is simplified. A special issue with this pump is closing the liquid discharge valve for shipping purposes. The need to do this is avoided by instead closing the liquid inlet port by means of an end enlargement 842 on the end of a port closing rod 86. This rod extends up to a snap engagement in the bottom mouth of the plunger stem 13. With the plunger 1 urged up by the spring, the rod 86 is pulled up and holds the liquid inlet port shut. When the plunger is first depressed, its stem mouth snaps out of the groove at the head 861 of the port closer rod 86 and dispensing can proceed.

With reference to FIGS. 12 to 17, a fifth embodiment of dispensing system comprises a foam-generating dispenser 1, 10, secured by a threaded cap 95 onto the neck of a container 91.

The construction of the foam dispensing pump is generally as described in the first embodiment above. Thus, the pump body element provides two coaxial cylinder portions, a lower liquid cylinder 121 defining a liquid pump chamber 127 and an upper, larger-diameter air cylinder defining an air chamber 126. Correspondingly the plunger 1 carries two pistons, an inner liquid piston 122 and an outer air piston 125 working in their respective cylinders. Liquid from the liquid chamber (which has a conventional ball inlet valve 129) is pumped up the hollow stem 124 of the liquid piston to a foam generating area 128 where it emerges as fine jets. In the same stroke of the pump, air is forced from the air chamber 126 through the air outlet valve 1212. A core component 143 encloses the foam-generating region where the pumped air and liquid meet and are forced together up through a foam-regulating element having upper and lower meshes 142, 141. This element is seated in the discharge channel 134 of the plunger head, which leads vertically up to the top of the plunger and then sideways to a spout 132.

The precise details of the plunger 1 are not critical, but the following are relevant. Firstly, the top of the plunger is a one-piece moulded element having a central tubular extension 133 providing the discharge passage and an outer cylindrical shroud 131, with an interior space 136 between them around the central tube 133 and the foam-generating core 143. The air piston 125 is snapped sealingly into the bottom of this plunger shroud 131 at a joint 138. The air intake valve 146 for the air pump therefore opens from the interior space 136 of the plunger.

The outer surface of the shroud 131 fits closely through the central hole of the securing cap 95, which has a sealing lip 151 to ensure a seal. The dispenser is designed for use in the shower and this seal keeps falling water out of the pump.

Other components shown are a dip tube 94 from the pump inlet down into the container and a cover cap 107.

Supply of air into the air cylinder 126 is from the plunger interior 136, so it is important to allow air into that interior space. At the same time it is important to keep water out of it, since any such water will accumulate in the air cylinder 126 and gradually spoil foam production.

To this end we provide a special conformation of the plunger top as is now described. The top (integral) wall 137 of the plunger casing slopes down towards the rear. A discrete moulded plastics cover element 156 is clipped onto it by means of downward prongs 161 fitting tightly in corresponding sockets 130 of the plunger casing. The top face of the plunger casing is slightly recessed inside a peripheral rim 1310 (see FIG. 15). The cover 156 fits down closely inside this to form a smooth exterior contour. At the rear of the plunger top the rim 1310 is interrupted by a notch 172. The cover 156 has a rearward lug 166 which fits into this notch, covering it from above but not blocking off its rear opening.

With reference to FIGS. 15 to 17, the top surface of the top wall 137 of the plunger has two curved grooves 171 which communicate with the rear notch 172 and lead forward from it in a curve around to either side of the region above the discharge channel tube 133. These grooves do not penetrate the top wall except at their forward extremities where each has a through hole 173 communicating with the plunger's interior space 136. The underside of the cover 156 has a smooth surface closely complementing the top of the plunger wall 137 except at these grooves 171, where the cover is plain and acts as a lid to form closed channels leading between the cover and plunger wall 137 forward from the rear notch 172 to each of the front through-openings 173.

By this means there is a substantial venting capacity to the interior space 136 of the plunger, enabling operation of the foam-generating pump's air cylinder 126. Because the external opening 172 of the vent is at the rear of the button between two components (which may for example be colour-contrasting) it is visually unobtrusive. Because the channels 171 between the entry openings 172 and the actual through-holes 173 are relatively narrow and elongate, the chance of water getting right through is small. Because the channels slope back to the entry opening 172, any water that does get in almost inevitably drains away before reaching the entry holes 173.

There is a container vent hole 1211 through the wall of the air cylinder. This hole 1211 is closed by the air piston in its rest position i.e. the upward position, towards which it is biased by a pump spring 123.

Because in this embodiment the plunger shroud 131 is sealed by the lip 151 in the cap 95, and the air cylinder inlet 146 is the only way out of the plunger's interior space, compensation air for the container interior does not come through the plunger. Instead, a small localised notch 1213 in the cap underside provides a leak between the space below the cap and the threaded engagement region between the cap and the outside of the container neck. Sufficient air can pass here from the outside down to the hole 1211 to compensate for the relatively small volume of liquid dispensed in each stroke.

FIGS. 18, 19 show details of the venting of the internal plunger space of a further embodiment, whose plunger head has a large, rounded top surface 237 designed for palm actuation. The top of the main plunger element has a shallow circular depression 2378 with a central upstanding cylindrical socket 2371. A pair of vent holes 273 is provided through the top wall of the plunger head to the internal cavity thereof, to either side of the plunger course leave in this central region. A domed, circular cover element 206 has a downward central stud 2062 by which it clips into the socket 2371 to cover the circular area 2378 with its through-holes 273. This cover element 206, which preferably has a colour contrast with the remainder of the plunger, provides a runoff for water which lands on the plunger top while at the same time leaving a small annular crack around its periphery through which venting air can easily enter the plunger interior via the holes 273, for refilling the air cylinder after each foam-dispensing stroke. Other elements of the dispenser are substantially as seen previously.

FIG. 20 describes a further embodiment, again corresponding in general respects to the embodiment of FIG. 1 but with the following significant differences.

Firstly, the plunger is adapted to cover the air vent as in the previous two embodiments. In this embodiment the cover element 406 is not a mere adjunct but rather constitutes the entire top of the plunger 1, comprising in an integral one-piece whole the discharge nozzle 412, top plunger wall with its rearwardly-inclined surface and finger-engagement depression, a downward central core sleeve portion 411 which forms the top part of the housing for the permeable filter element 81, and a downward short outer skirt 4063. This outer skirt 4063 is a tight snap fit into the top of the main cylindrical tubular wall 5 of the plunger cap. The outer tubular wall 5 is molded in one piece, via a lower bridge having vent apertures 314, with the upwardly-projecting tubular wall or sleeve 32 that compliments the downward sleeve 411 to enclose the mesh module 81. This avoids increasing the component count. The rear of the downward skirt 4063 of the cover plug 406 is interrupted by a narrow notch 4064 which in the assembled plunger cap aligns with an exterior shaped notch 511 adjacent the top rim of the tubular wall 51, to the rear side. The rear edge of the cover plug 406 has an overhang 421 which slides down over this notch but at a clearance, so that the vent channel is defined between the two components to extend upwardly from its rear entry opening, over the top edge of the wall 5 via a small clearance and into the cap interior via the notch 4064. From the cap interior, the air can reach the air cylinder inlet valve (which is as in the previous embodiments) via the vent apertures 314.

Another feature in this embodiment is that the simple open tubular formation of the plunger wall 5 enables the lower edge of the this tube to be moulded with an integral radaial flange 52. This flange retains the plunger more securely in the pump, by engagement beneath the edge of the securing cap. There is a slight variation also in the splined plug 31 which fits into the liquid discharge passage to provide a liquid discharge in the form of an essentially tubular high-velocity curtain flow. Here the plug 31 is a discrete component fitting into the top of the liquid discharge stem. As before the air discharge is brought in to impinge radially inwardly on this curtain flow before the mixed flows rise through the meshes.

A further modification relates to venting of the container to compensate for dispensed liquid. In the embodiment of FIG. 1 this venting was by way of the small opening 109 through the air cylinder 101, intended to be covered in the rest condition by the air piston. In practice such a hole may allow liquid to escape between the plunger sleeve and threaded retaining cap, or into the air cylinder, particularly if the container is tipped. Thus, the present embodiment allows venting instead between the threads of the container neck 92 and the retaining collar. Leakage is avoided by an elastomeric gasket 199 trapped beneath the pump body flange and the container neck edge. Such a gasket is conventionally used and would normally prevent venting, but in this variant the container body flange has a localized vent opening 1001 and the gasket 199 has a thinner, more flexible inner flange projecting out to cover this opening to form a vent valve. Under normal conditions this keeps air out and prevents escape of liquid with the bottle tipped. Negative pressure in the container after dispensing draws air in by flexing the lip 299.

What is claimed is:

1. A foam dispenser comprising a combined liquid pump and air pump for mounting at the top of a container of foamable liquid, the liquid pump having a liquid cylinder and a liquid piston defining between them a liquid chamber, the air pump having an air cylinder and an air piston defining between them an air chamber, and the liquid piston and air piston being reciprocable together in their respective cylinders by the action of a pump plunger which carries said pistons;

an air inlet valve and liquid inlet valve being provided for the air chamber and liquid chamber respectively;

an air discharge passage and a liquid discharge passage leading from the air chamber and the liquid chamber respectively, the air discharge passage and liquid discharge passage meeting one another for combinations of pumped flows of air and liquid and passing to an outlet passage and foam discharge opening of the dispenser by way of a permeable foam regulation element;

and wherein the pump plunger comprises a core sleeve in surrounding relation to the outlet passage, a foam discharge nozzle, defining said foam discharge opening, and an outer cap shroud having an outer skirt which extends down and connects fixedly to the air piston adjacent a peripheral seal of the air piston so as to define an internal cap chamber above a roof of the air piston and enclosing the air inlet valve and the outer cap shroud has one or more external vent openings separate from the foam discharge opening to admit air to the cap chamber for drawing into the air chamber through the air inlet valve.

2. A foam dispenser according to claim 1 in which the air cylinder, the liquid cylinder and their respective pistons are arranged concentrically around the plunger axis.

3. A foam dispenser according to claim 1 in which the air piston comprises an outer sleeve portion which carries the peripheral seal of the piston, and the air inlet valve comprises a radially-inwardly-projecting flexible valve flap formed integrally with the outer sleeve portion of the air piston.

4.A foam dispenser according to claim 3 in which an air inlet valve seat relative to which the air inlet valve flap is flexible is a downwardly-directed edge on said core sleeve.

5. A foam dispenser according to claim 3 in which the air discharge passage extends up inside the plunger's core sleeve alongside the liquid discharge passage, and the core sleeve carries an air outlet valve seat and an air outlet valve flap constituting the air outlet valve.

6. A foam dispenser according to claim 4 in which a plunger core sleeve portion having said downwardly-directed edge of the air inlet valve seat also comprises the flexible flap of an air outlet valve.

7. A foam dispenser according to claim 6 in which the air outlet valve flap is a radially-projecting flap in axial register with the air inlet valve flap.

8. A foam dispenser according to claim 1 in which the core sleeve has upper and lower parts which fit together to define a housing enclosing the permeable foam regulation element.

9. A foam dispenser according to claim 1 in which the permeable foam regulation element comprises a cylindrical sleeve with a first mesh across its lower end and a second mesh across its upper end, the first mesh being coarser than the second mesh.

10. A foam dispenser according to claim 1 in which the plunger's outer cap shroud includes a discrete cover element overlying said one or more vent openings.

11. A foam dispenser according to claim 10 in which a vent path is defined between opposed surfaces of the discrete cover element and a further element of the plunger cap shroud onto which it is secured.

12. A foam dispenser according to claim 11 in which the discrete cover element comprises a top lid incorporating said foam discharge nozzle for the dispenser, secured to a lower element of the plunger in such a manner as to put said discharge nozzle in communication with said outlet passage.

13. A foam dispenser according to claim 11 in which the vent path is elongate.

14. A foam dispenser according to claim 11 in which the vent path is tortuous.

15. A foam dispenser according to claim 11 in which the discrete cover element is laminar, and comprises integral fasteners to secure it to a main casing of the plunger's outer cap shroud.

16. A foam dispenser according to claim 10 in which the discrete cover element is on top of the plunger.

17. A foam dispenser according to claim 16 in which the cover element provides a top region of the plunger sloping down to the rear thereof, with said external vent openings at the rear of plunger, opening below a rear edge of the cover element.

18. A foam dispenser comprising a combined liquid pump and air pump for mounting at the top of a container of foamable liquid, the liquid pump having a liquid cylinder and a liquid piston defining between them a liquid chamber, the air pump having an air cylinder and an air piston defining between them an air chamber, and the liquid piston and air piston being reciprocable together in their respective cylinders by the action of a pump plunger which carries said pistons;

an air inlet valve and liquid inlet valve being provided for the air chamber and liquid chamber respectively;

an air discharge passage and a liquid discharge passage leading from the air chamber and the liquid chamber respectively, the air discharge passage and liquid discharge passage meeting one another for combinations of pumped flows of air and liquid and passing to an outlet passage of the dispenser by way of a permeable foam regulation element;

and wherein the pump plunger comprises a core sleeve in surrounding relation to the outlet passage and an outer cap shroud having an outer skirt which extends down and connects fixedly to the air piston adjacent a peripheral seal of the air piston so as to define an internal cap chamber above a roof of the air piston and enclosing the air inlet valve, the air piston comprising an outer sleeve portion which carries the peripheral seal of the piston, and the air inlet valve comprising a radially-inwardly-projecting flexible valve flap formed integrally with the outer sleeve portion of the air piston.

19. A foam dispenser according to claim 18 in which the air cylinder, the liquid cylinder and their respective pistons are arranged concentrically around the plunger axis.

20. A foam dispenser according to claim 18 in which an air inlet valve seat relative to which the air inlet valve flap is flexible is a downwardly-directed edge on said core sleeve.

21. A foam dispenser according to claim 20 in which the air discharge passage extends up inside the plunger's core sleeve alongside the liquid discharge passage, and the core sleeve carries an air outlet valve seat and an air outlet valve flap constituting the air outlet valve.

22. A foam dispenser according to claim 20 in which a plunger core sleeve portion having said downwardly-directed edge of the air inlet valve seat also comprises the seat of an air outlet valve.

23. A foam dispenser according to claim 22 in which the air outlet valve flap is a radially-projecting flap in axial register with the air inlet valve flap.

24. A foam dispenser according to claim 18 in which the core sleeve has upper and lower parts which fit together to define a housing enclosing the permeable foam regulation element.

25. A foam dispenser according to claim 18 in which the permeable foam regulation element comprises a cylindrical sleeve with a first mesh across its lower end and a second mesh across its upper end, the first mesh being coarser than the second mesh.

26. A foam dispenser comprising a combined liquid pump and air pump for mounting at the top of a container of foamable liquid, the liquid pump having a liquid cylinder and a liquid piston defining between them a liquid chamber, the air pump having an air cylinder and an air piston defining between them an air chamber, and the liquid piston and air piston being reciprocable together in their respective cylinders by the action of a pump plunger which carries said pistons and defines an outlet passage and foam discharge opening;

an air inlet valve and liquid inlet valve being provided for the air chamber and liquid chamber respectively;

an air discharge passage and a liquid discharge passage leading from the air chamber and the liquid chamber respectively, the air discharge passage and liquid discharge passage meeting one another for combinations of pumped flows of air and liquid which pass to the outlet passage and foam discharge opening of the dispenser by way of a permeable foam regulation element;

and wherein the pump plunger comprises a plunger casing comprising an outer cap shroud which defines an internal cap chamber communicating with the air inlet valve, the plunger casing having one or more vent openings, separate from the outlet passage, to admit outside air to the cap chamber for drawing into the air chamber through the air inlet valve, the plunger further comprising a discrete top cover element which overlies the one or more vent openings.

27. A foam dispenser according to claim 26 in which a vent channel extending from the vent opening to the internal cap chamber is entirely defined between opposed surfaces of the cover element and a plunger casing part onto which the cover element is secured.

28. A foam dispenser according to claim 26 in which a venting clearance is defined between the discrete cover element and a plunger casing part onto which the cover element is secured, and a vent path from the vent opening to the internal cap chamber is defined through an external entry opening, defined on one side by an edge of the cover element, then through said venting clearance between the discrete cover element and said plunger casing part, and then through at least one opening leading through said plunger casing part into the internal cap chamber.

* * * * *